US011932461B2

(12) United States Patent
Garuti et al.

(10) Patent No.: US 11,932,461 B2
(45) Date of Patent: Mar. 19, 2024

(54) SHEET PACKAGING MATERIAL FOR PRODUCING SEALED PACKAGES FOR LIQUID FOOD PRODUCTS

(71) Applicant: TETRA LAVAL HOLDINGS & FINANCE S.A., Pully (CH)

(72) Inventors: Nicola Garuti, Scandiano (IT); Marcello Barbieri, Modena (IT)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 76 days.

(21) Appl. No.: 17/622,449

(22) PCT Filed: Jun. 24, 2020

(86) PCT No.: PCT/EP2020/067737
§ 371 (c)(1),
(2) Date: Dec. 23, 2021

(87) PCT Pub. No.: WO2020/260409
PCT Pub. Date: Dec. 30, 2020

(65) Prior Publication Data

US 2022/0355969 A1 Nov. 10, 2022

(30) Foreign Application Priority Data

Jun. 27, 2019 (EP) ..... 19183042

(51) Int. Cl.
*B65D 5/06* (2006.01)
*B65D 5/42* (2006.01)
*B65D 85/72* (2006.01)

(52) U.S. Cl.
CPC ..... *B65D 5/06* (2013.01); *B65D 5/4266* (2013.01); *B65D 85/72* (2013.01)

(58) Field of Classification Search
CPC ..... B65D 5/06; B65D 5/4266; B65D 85/72; B65D 5/029; B65D 5/5405; B65D 5/064; B65D 5/067; B65D 5/40; B65D 5/10
USPC ..... 229/124, 137, 125.42, 127, 185, 5.82, 229/5.84; D9/431; 53/565
See application file for complete search history.

(56) References Cited

U.S. PATENT DOCUMENTS

| | | | | |
|---|---|---|---|---|
| 416,817 | A | 12/1889 | Veneman | |
| 996,746 | A | 7/1911 | Bloomer | |
| 5,531,375 | A * | 7/1996 | Palm | B65D 5/06 229/110 |
| 6,119,928 | A | 9/2000 | Lasson et al. | |

(Continued)

FOREIGN PATENT DOCUMENTS

| | | | |
|---|---|---|---|
| DE | 69914181 | T2 | 6/2004 |
| EP | 2650223 | A1 | 10/2013 |

OTHER PUBLICATIONS

International Search Report (PCT/ISA/210) and Written Opinion (PCT/ISA/237) dated Jul. 31, 2020, by the European Patent Office as the International Searching Authority for International Application No. PCT/EP2020/067737.

*Primary Examiner* — Christopher R Demeree
(74) *Attorney, Agent, or Firm* — BUCHANAN INGERSOLL & ROONEY PC

(57) ABSTRACT

A sheet packaging material for producing a sealed package containing a food product, comprising crease lines that have sections that are angled towards each other such that at least two sides panels of the sealed package are given a trapezoidal shape.

10 Claims, 7 Drawing Sheets

(56) References Cited

U.S. PATENT DOCUMENTS

| | | | | |
|---|---|---|---|---|
| 7,325,719 | B2 * | 2/2008 | Palm | B65D 5/067 53/565 |
| D668,539 | S * | 10/2012 | Barbieri | D9/431 |
| D679,588 | S * | 4/2013 | Martini | D9/433 |
| 8,584,927 | B2 * | 11/2013 | Rimondi | B65B 49/08 229/137 |

* cited by examiner

SHEET PACKAGING MATERIAL FOR PRODUCING SEALED PACKAGES FOR LIQUID FOOD PRODUCTS

TECHNICAL FIELD

The invention relates to a sheet packaging material for producing a sealed package containing a liquid food product. It also relates to a sealed package made of the sheet packaging material and containing a liquid food product.

BACKGROUND ART

As commonly known, many liquid food products, such as fruit juice, pasteurized milk, UHT (ultra-high-temperature treated) milk, yoghurt and other fermented dairy products, wine, tomato sauce, soups etc. are sold in different types of packages, some of which are made of a packaging material that has been sterilized.

A typical package example is the package for liquid or pourable food products known as Tetra Brik Aseptic (registered trademark), which is made by folding, sealing and cutting a web of laminated packaging material. In particular, the packaging material has a multilayer structure comprising a base layer, e.g. of paper, covered on both sides with layers of heat-seal plastic material, e.g. polyethylene. In the case of aseptic packages for long-storage products, such as UHT milk, the packaging material also comprises a layer of oxygen-barrier material, e.g. an aluminum foil, which is superimposed on a layer of heat-seal plastic material, and is in turn covered with another layer of heat-seal plastic material forming the inner face of the package eventually contacting the food product.

Packages of this sort are normally produced by fully automatic packaging machines in which a continuous tube is formed from the web-fed packaging material; the web of packaging material is often sterilized on the packaging machine, e.g. by applying a chemical sterilizing agent, such as a hydrogen peroxide solution, which, once sterilization is completed, is removed from the surfaces of the packaging material, e.g. evaporated by heating. The web so sterilized is then maintained in a closed, sterile environment, and is folded and sealed longitudinally to form a tube, which is fed vertically.

In order to complete the forming operations, the tube is filled with the liquid food product, which may be sterilized as applicable, and is sealed and subsequently cut along equally spaced cross sections; pillow packs are so obtained, which are then folded mechanically to form respective finished packages at a final folder.

To allow folding of the web packaging material both during forming and final folding, crease lines, i.e. weakening lines, are formed on the packaging material at the production plant by creasing tools. In practice, the crease lines define folding lines along which the pillow packs are folded to obtain the desired final configuration.

Alternatively, the packaging material may be cut into blanks, which are formed into packages on forming spindles. The resulting packages are then filled with the food product and sealed. One example of this type of package is the so-called "gable-top" package known by the trade name Tetra Rex (registered trademark).

To open the above-described packages they may be provided with a removable portion, which is partly detached by an opening device from the rest of the packaging material to free a pour opening through which to pour out the product.

The removable portion is formed on the packaging material prior to folding and sealing the packaging material to form the finished package.

The removable portion may comprise a so-called "prelaminated" hole, i.e. a circular hole formed through the base layer only of the packaging material and covered, when the material is laminated, with the layers of heat-seal plastic material and barrier material, which adhere to one another at the hole.

Each package of the above type, either cut from a tube of packaging material or formed on a forming spindle, is obtained from a basic unit of packaging material having given crease lines.

In other words, the above-mentioned basic unit represents the exact length of the packaging material used to produce one single package.

In the case of packages made from a tube of packaging material, the original web includes a plurality of basic units joined to each other; in the case of packages made on forming spindles, the basic unit is defined by the blank cut from the web prior to starting the forming and sealing operations.

The basic unit typically has a rectangular or square configuration with two boundary edges parallel to a longitudinal direction and two other boundary edges parallel to a transversal direction orthogonal to the longitudinal direction.

Once the basic unit is folded and sealed to form the finished package, the longitudinal direction becomes the direction along which the total height of the package itself is defined; the longitudinal direction also represents the main direction of extension of the web from which the basic unit is obtained.

The basic unit usually includes at least two transversal crease lines extending transversally to the longitudinal direction and dividing the basic unit itself into: a bottom region containing a bottom crease pattern and configured to form a bottom portion of the finished package; a top region containing a top crease pattern and configured to form a top portion of the finished package; and an intermediate region contained between the transversal crease lines, interposed between the bottom region and the top region and usually having a plurality of longitudinal crease lines designed to form lateral edges of a plurality of side walls of the finished package. Depending on the orientation of the package, the intermediate region of the basic unit may instead form the top, the bottom and two opposite sides of the package, while the bottom and top region of the basic unit form the two remaining, opposite sides of the package.

The bottom portion of the finished package normally includes a flat and horizontal bottom panel defining the resting surface of the package itself.

The top portion of the finished package may include a flat and horizontal top panel, parallel to the bottom panel. For some types of packages slanted top panels are conveniently used in combination with opening devices because they are wider than corresponding flat top panels of parallelepiped or prismatic packages and therefore allow the application of larger opening devices, e.g. provided with screw caps or the like. Other opening devices and principles then those mentioned are often used.

As it is known, after their production, packages are transported to sale points by placing them on transport pallets, which have pre-determined sizes. A need is therefore particularly felt in the packaging field to optimize filling of the transport pallets with the finished packages while maintaining a pleasing appearance of such packages.

Depending on product and the intended application area of the package and in some cases also on how the package is intended to be opened, different size and form of packages are often desired.

SUMMARY

It is therefore an object of the invention to provide a sheet packaging material and a sealed package containing a liquid food, which allows meeting the above-mentioned need and desire in a straightforward and cost-efficient manner.

To solve these objects a sheet packaging material and a package according to the appended claims are provided. The sheet packing material and package are advantageous in that they offer a package that has a shape which resembles a cup having a base that is narrower than its top, i.e. the area of the bottom of the package is smaller than the area of the top of the package. This provides for making it easier to empty the product from the package, in particular when spooning the product out from the package.

Other objectives, features, aspects and advantages of the invention will appear from the following detailed description as well as from the drawings.

BRIEF DESCRIPTION OF THE DRAWINGS

Embodiments of the invention will now be described, by way of example, with reference to the accompanying schematic drawings, in which.

DETAILED DESCRIPTION

Figure 1A:
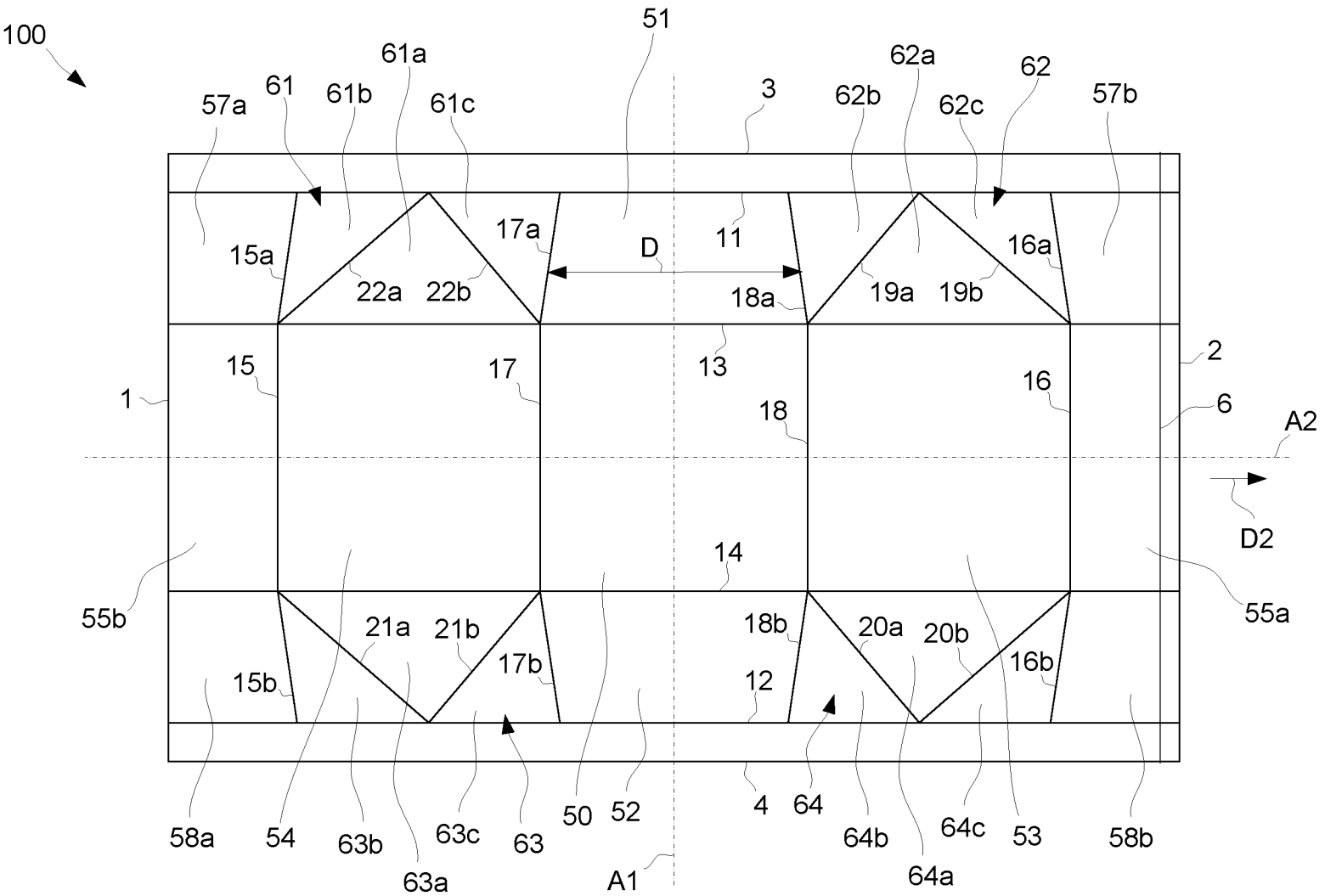
FIG. 1*a* is a top view of a sheet packaging material for producing a sealed package according to a first embodiment.

With reference to FIGS. 1*a*-1*d* a sheet packaging material 100 for producing a sealed package 101 containing a food product is illustrated. The sheet packaging material 100 correspond to a "basic unit" as desired above. It is made of a web of laminated packaging material that has a multilayer structure comprising a base layer, e.g. of paper, covered on both sides with layers of heat-seal plastic material, e.g. polyethylene. It may have a layer of oxygen-barrier material, e.g. an aluminium foil, which is superimposed on a layer of heat-seal plastic material, and is in turn covered with another layer of heat-seal plastic material forming the inner face of the package eventually contacting the food product.

To fold the sheet packaging material 100 into the package 101 it has a number of crease lines, i.e. weakening lines, that are formed on the packaging material at the production plant by creasing tools. The folding of the sheet packaging material 100 to form the package 101 is done along these crease lines. The manufacturing of the web of laminated packaging material that the sheet packaging material 100 is made of is per se accomplished according to suitable and commonly available techniques. Also, any suitable and commonly available techniques may be used for creating the crease lines on the sheet packaging material 100. Known techniques may also be used for folding the sheet packaging material 100 into the sealed package 101, for filling liquid food product and for performing the final sealing that forms the sealed package 101 containing the product. The invention herein concerns in particular the specific configuration of the crease lines and thus the final shape of the sealed package 101.

In detail, the sheet packaging material 100 has four edges. The first edge 1 and the second edge 2 are two opposite and parallel edges. The third edge 3 and the fourth edge 4 are two opposite and parallel edges. The third and fourth edges 3, 4 join the first and second edges 1, 2, which thereby gives the sheet packaging material 100 a rectangular shape.

A first crease line 11 and a second crease line 12 extend in parallel between the first and second edges 1, 2, i.e. from the first edge 1 to the second edge 2. A third crease line 13 and a fourth crease line 14 extend in parallel between the first and second edges 1, 2 and intermediate the first and second crease lines 11, 12. The third crease line 13 and a fourth crease line 14 are thus closer to a center of the sheet packaging material 100 than the first crease line 11 and the second crease line 12. A fifth crease line 15 and a sixth crease line 16 extend between the first and second crease lines 11, 12. A seventh crease line 17 and an eight crease line 18 extend between the first and second crease lines 11, 12 and intermediate the fifth and sixth crease lines 15, 16. The seventh crease line 17 and a eight crease line 18 are thus closer to the center of the sheet packaging material 100 than the fifth crease line 15 and the sixth crease line 16.

The crease lines 11-18 divide the sheet packaging material 100 into seven portions: a central portion 50, a first side portion 51, a second side portion 52, a third side portion 53, a fourth side portion 54 and two end portions 55*a*, 55*b*.

Figure 1B:
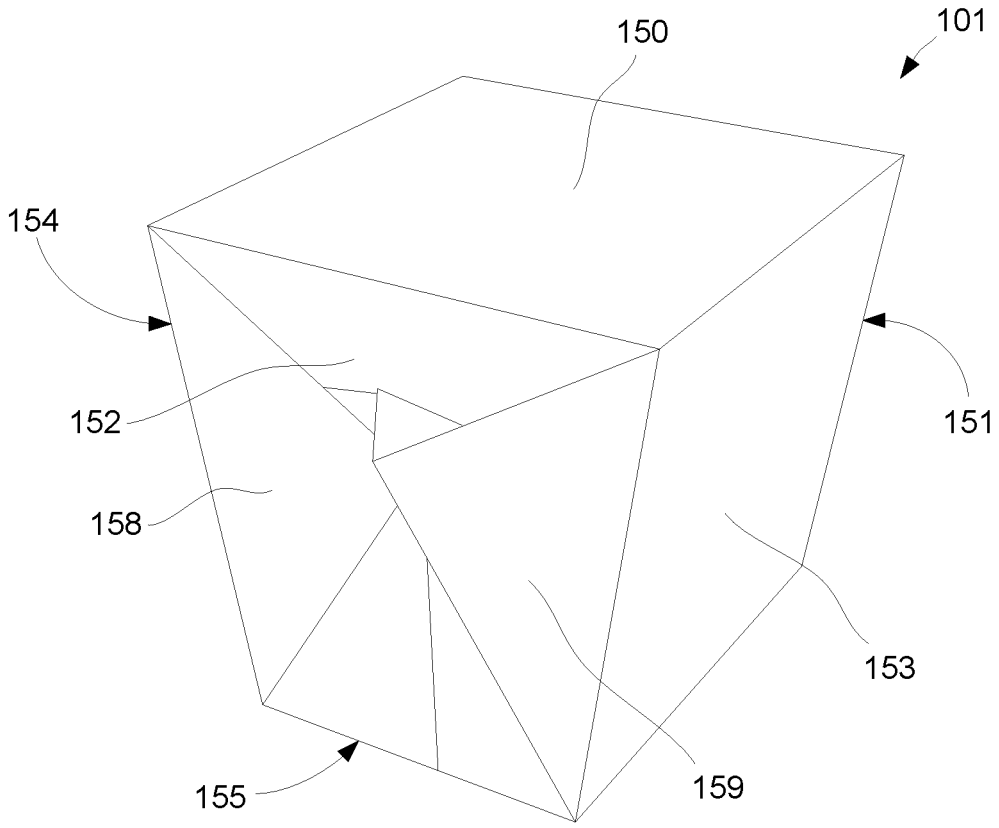
FIG. 1*b* is a perspective view of the package produced by the sheet packaging material shown in FIG. 1*a*.

The central portion 50 has a rectangular shape and forms a top panel 150 of the sealed package 101, see FIG. 1*b*. The first side portion 51 and a second side portion 52 are adjacent the central portion 51 and opposite each other, and form a first side panel 151 and a second side panel 152 of the sealed package 101. The third side portion 53 and the fourth side portion 54 are adjacent the central portion 51 and opposite each other and form a third side panel 153 and a fourth side panel 154 of the sealed package 101. The two end portions 55*a*, 55*b* are adjacent two of the side portions 53, 54, more specifically and in the illustrated embodiment adjacent the third side portion 53 and the fourth side portion 54. The end portions 55*a*, 55*b* are arranged to, when the sheet packaging material 100 is folded into the sealed package 101, be joined to each other to form a bottom panel 155 of the sealed package 101. The end portions 55*a*, 55*b* overlap at the line indicated by reference numeral 6.

The seventh and eight crease lines 17, 18 has a first pair of crease sections 17*a*, 18*a* that define two opposite sides of the first side portion 51. The first pair of crease sections 17*a*, 18*a* are angled towards each other such that the first side portion 51 has a trapezoidal shape.

The seventh and eight crease lines 17, 18 also has a second pair of crease sections 17*b*, 18*b* that define two opposite sides of the second side portion 52. The second pair of crease sections 17*b*, 18*b* are angled towards each other such that the second side portion 52 also has a trapezoidal shape.

Figure 1C:
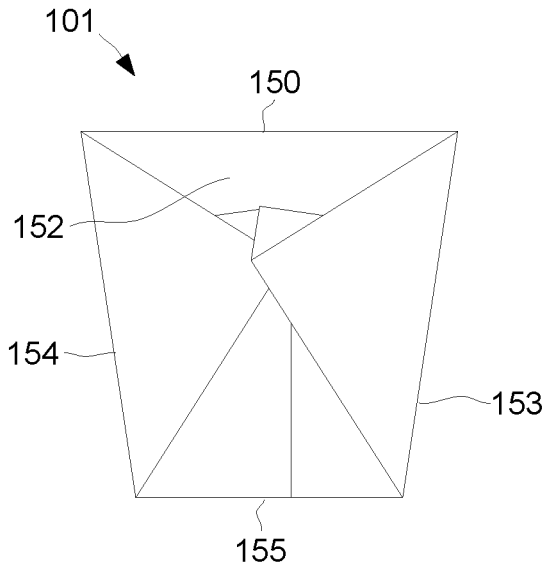
FIG. 1*c* is a side view of the package produced by the sheet packaging material shown in FIG. 1*a*.
Figure 1D:
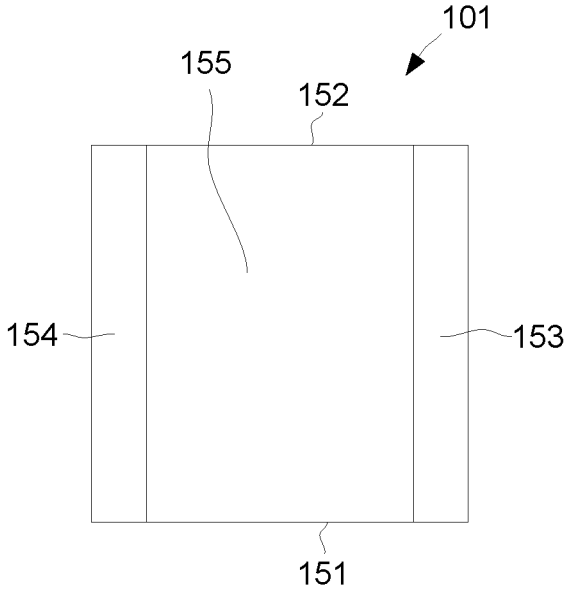
FIG. 1*d* is a bottom view of the package produced by the sheet packaging material shown in FIG. 1*a*.
Figure 2A:
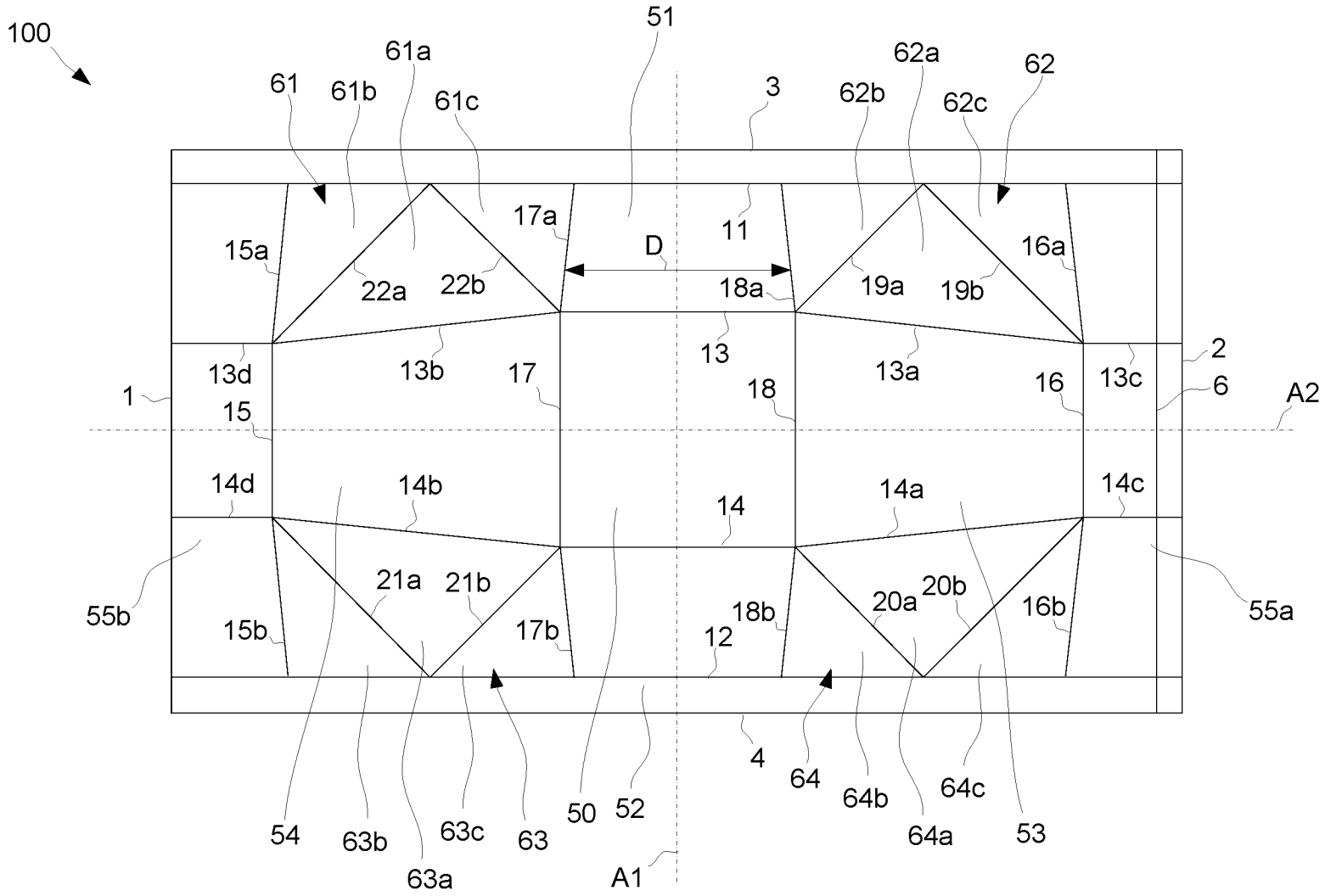
FIG. 2*a* is a top view of a sheet packaging material for producing a sealed package according to a second embodiment.
Figure 2B:
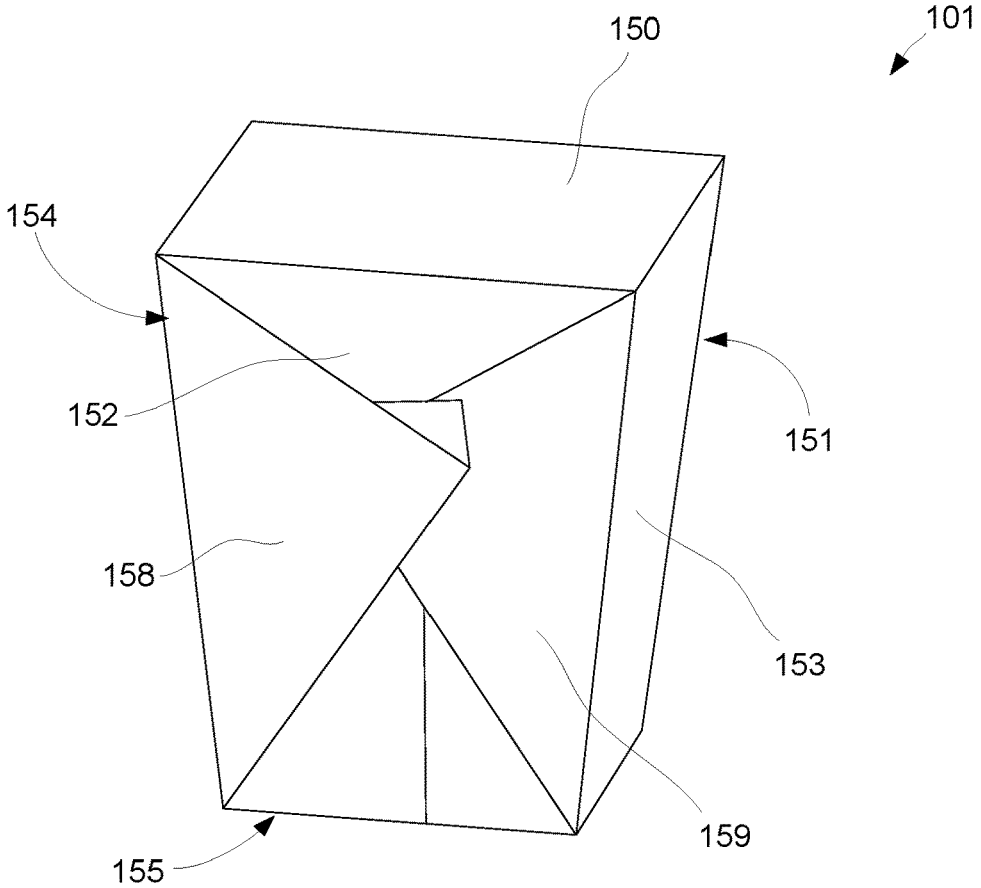
FIG. 2*b* is a perspective view of the package produced by the sheet packaging material shown in FIG. 2*a*.
Figure 2C:
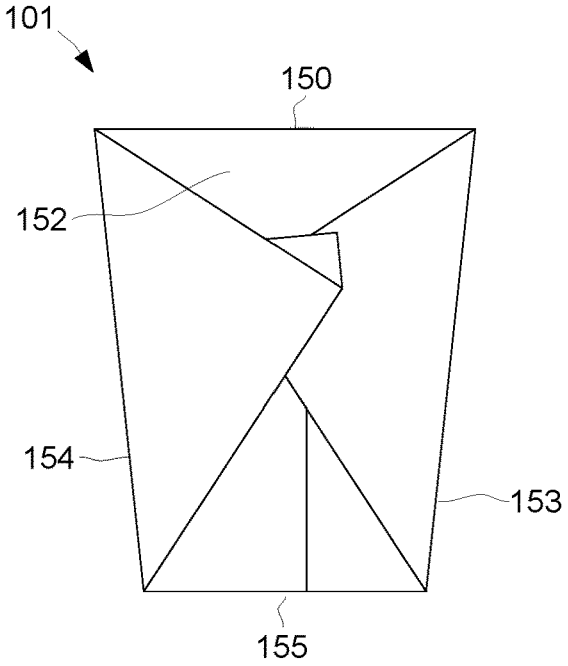
FIG. 2*c* is a side view of the package produced by the sheet packaging material shown in FIG. 2*a*.
Figure 2D:
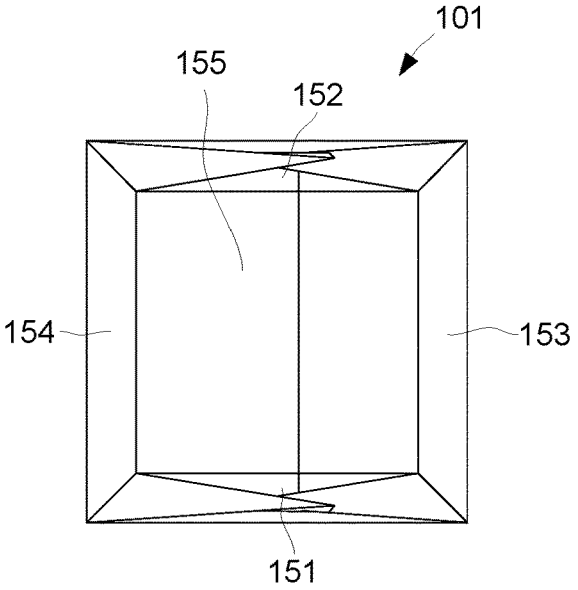
FIG. 2*d* is a bottom view of the package produced by the sheet packaging material shown in FIG. 2*a*.

The obtained trapezoidal shapes gives the sealed package 101, when folded from the sheet packaging material 100, side panels that also have a trapezoidal shape, see the two panels 153 and 154 in FIGS. 1*b*-1*d* and the four panels 151-154 in FIGS. 2*b*-2*d* respectively 3*b*-3*d*. More particularly, the trapezoidal panels have the shape of isosceles trapezoids. As a result an area of the bottom panel 155 is smaller than the area of the top panel 150. This provides for making it easier to empty product from the package, in particular when spooning the product out from the sealed package 101. Some examples of products that might be contained in the sealed package 101 are yoghurt and other fermented dairy products.

The first pair of crease sections 17*a*, 18*a* is, as seen relative the central portion 50, located opposite the second pair of crease sections 17*b*, 18*b*. The distance D between the angled crease sections of the first crease section 17*a*, 18*a* and the second crease section 17*b*, 18*b* decreases with the distance from central portion 50. This gives the top 150 of the sealed package 101 an area that is larger than the area the bottom 155 of the sealed package 101.

The first pair of crease sections 17*a*, 18*a* may be slanted towards each other with same angles, such that the first side portion 51 has the shape of an isosceles trapezoid. Corresponding situation may apply for the second pair of crease sections 17*b*, 18*b*, i.e. they may be slanted towards each other with same angles, such that the second side portion 52 has the shape of an isosceles trapezoid.

To fold the packaging material 100 into the sealed package 101 it may have the crease lines 11-18 dividing the sheet packaging material 100 also into four flap portions 61-64. Then the first flap portion 61 and the second flap portion 62 are adjacent to and on opposite sides of the first side portion 51 and form a first flap and a second flap that are folded on the first side panel 151 of the sealed package 101. The third flap portion 63 and the fourth flap portion 64 are adjacent to and on opposite sides of the second side portion 52 and form a third flap 158 and a fourth flap 159 that are folded on the second panel 152 of the sealed package 101. The fifth and sixth crease lines 15, 16 has a third pair of crease sections 15*a*, 16*a* that together with the first pair of crease section 17*a*, 18*a* define sides of the first flap portion 61 and the second flap portion 62. The third pair of crease sections 17*a*, 18*a* are angled towards each other such that the first flap portion 61 and the second flap portion 62 have the shape of a quadrilateral. The fifth and sixth crease lines 15, 16 have also a fourth pair of crease sections 15*b*, 16*b* that together with the second pair of crease section 17*b*, 18*b* define sides of the third flap portion 63 and the fourth flap portion 64. The fourth pair of crease sections 15*b*, 16*b* are angled towards each other such that the third flap portion 63 and the fourth flap portion 62 have the shape of quadrilaterals. In some embodiments the flap portions 61-64 have the shape of a parallelogram (FIGS. 1*a*-1*d*) while in other they have the shape of quadrilaterals (FIGS. 2*a*-2*d* and FIGS. 3*a*-3*d*).

The first flap portion 61 may have a respective pair of crease lines 22*a*, 22*b* that divide the first flap portion 61 into three sections 61*a*, 61*b*, 61*c* each having a triangular shape. The first crease line 22*a* of the pair of crease lines 22*a*, 22*b* is, as compared to the second crease line 22*b* of the pair of crease lines 22*a*, 22*b*, longer and located further away from a central line A1 that extends through the centers of the first and second side portions 51, 52. Another central line A2 is perpendicular to central line A1 and extends through the centers of the third and fourth side portions 53, 54.

The second, third and fourth flap portions 62-64 may have corresponding pair of crease lines 19*a*, 19*b*, 21*a*, 21*b*, 20*a*, 20*b* that divide these flap portions 62-64 into respective three sections 62*a*-62*c*, 63*a*-63*c* and 64*a*-64*c* each having a triangular shape.

With reference to FIGS. 2*a*-2*d* and 3*a*-3*d*, the third and fourth crease lines 13, 14 may have a fifth pair of crease sections 13*a*, 14*a* that define two opposite sides of the third side portion 53. The fifth pair of crease sections 13*a*, 14*a* are angled towards each other such that the third side portion 53 has a trapezoidal shape. In a corresponding manner, the third and fourth crease lines 13, 14 may comprise a sixth pair of crease sections 13*b*, 14*b* that define two opposite sides of the fourth side portion 54. The sixth pair of crease sections 13*b*, 14*b* are angled towards each other such that the fourth side portion 54 has a trapezoidal shape. From the fifth pair of crease sections 13*a*, 14*a* and the sixth pair of crease sections 13*b*, 14*b*, the crease lines 13, 14 have end sections 13*c*, 14*c* and 13*d*, 14*d* that extend to the first and second edges 1, 2 respectively, in parallel to the third and fourth edges 3, 4.

The distance between the angled crease sections of the fifth crease section 13*a*, 14*a* and the sixth crease section 13*b*, 14*b* may decrease with the distance from the central portion 50. As a result, the area of the top 150 of the sealed package 101 becomes even larger than the area the bottom 155 of the sealed package 101.

The fifth pair of crease sections 13*a*, 14*a* may be slanted towards each other with same angles, such that the third side portion 53 has the shape of an isosceles trapezoid. The sixth pair of crease sections 13*b*, 13*b* may also be slanted towards each other with same angles, such that the fourth side portion 54 has the shape of an isosceles trapezoid.

Figure 3A:
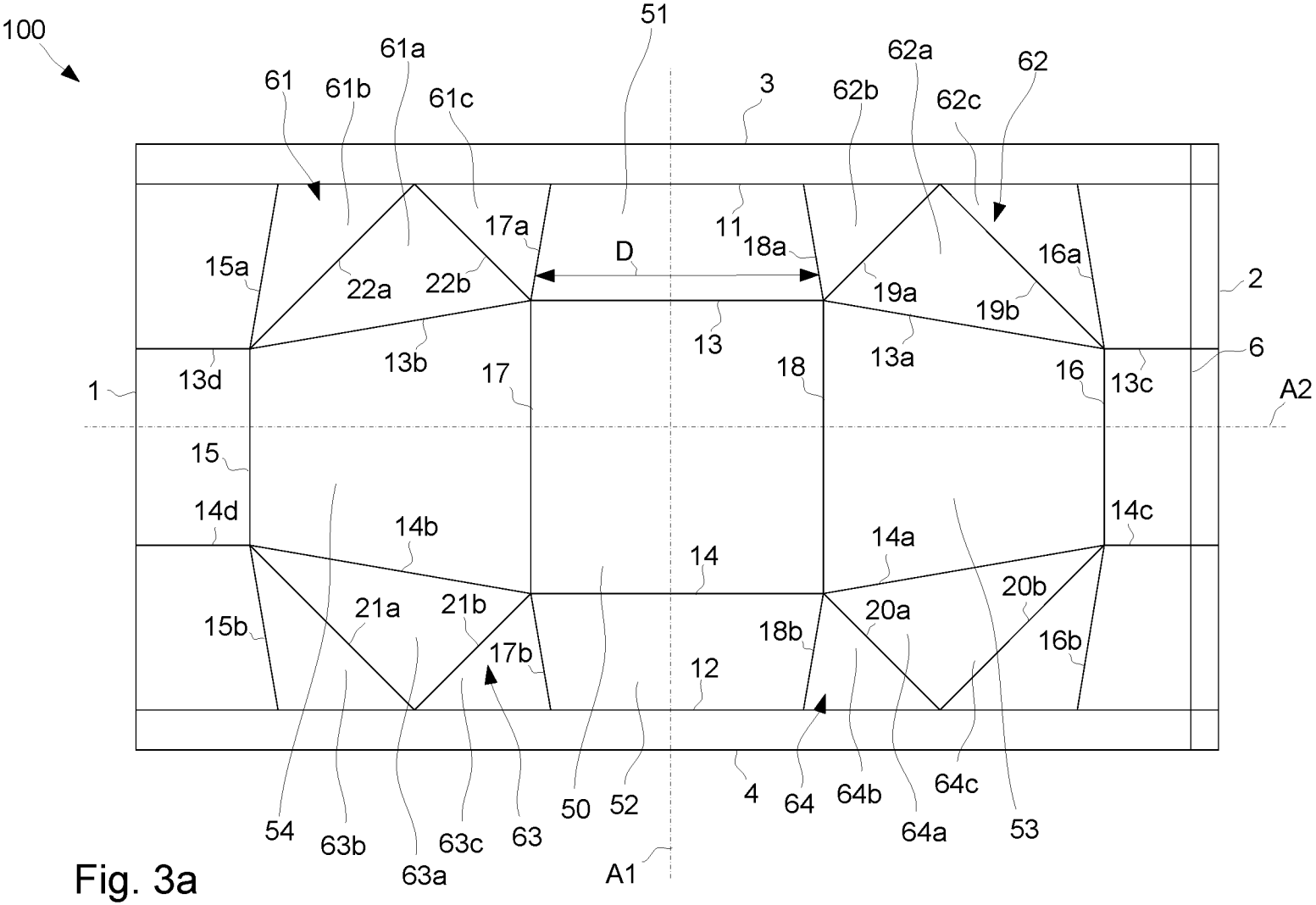
FIG. 3*a* is a top view of a sheet packaging material for producing a sealed package according to a third embodiment.
Figure 3B:
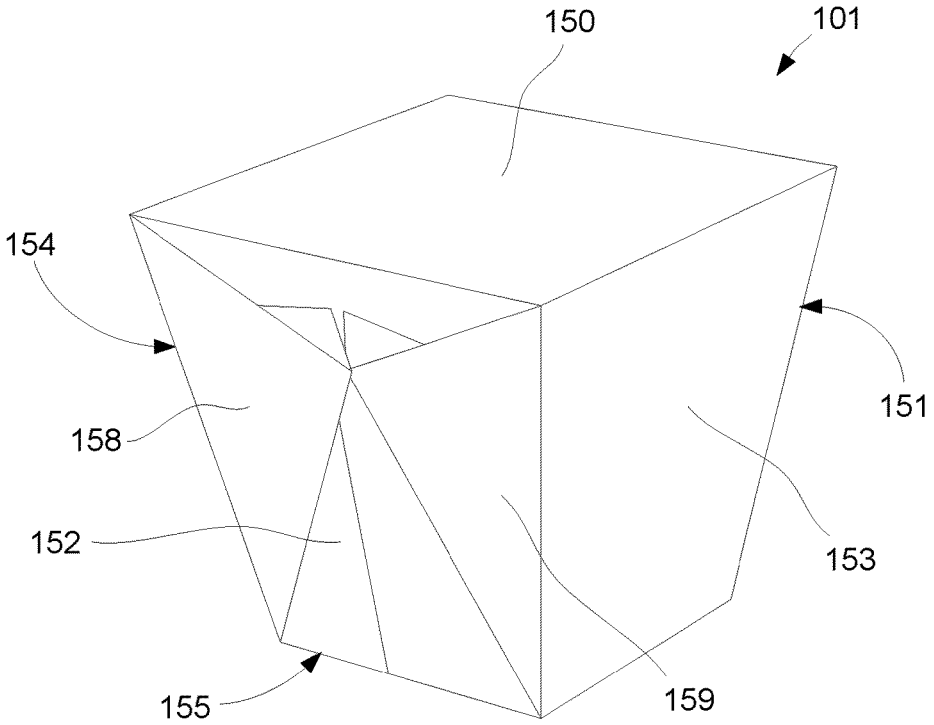
FIG. 3*b* is a perspective view of the package produced by the sheet packaging material shown in FIG. 3*a*.
Figure 3C:
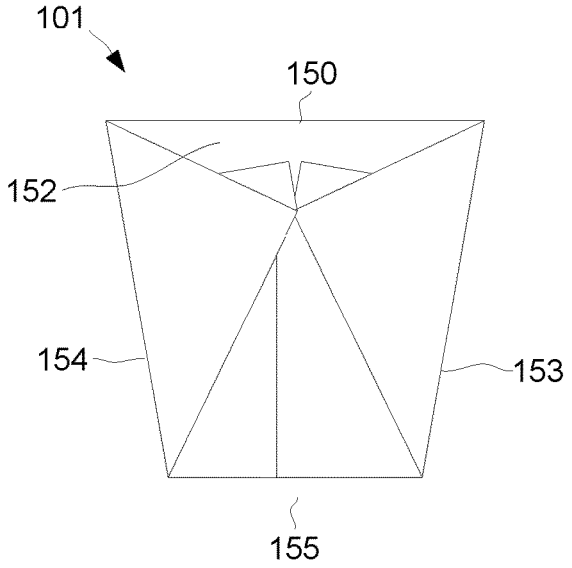
FIG. 3*c* is a side view of the package produced by the sheet packaging material shown in FIG. 3*a*.
Figure 3D:
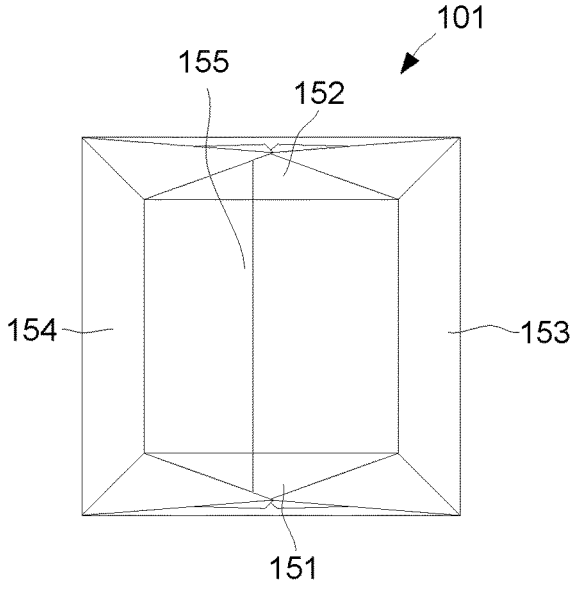
FIG. 3*d* is a bottom view of the package produced by the sheet packaging material shown in FIG. 3*a*.

With reference to FIGS. 3*a*-3*d*, the four flap portions 61-64 and their respective crease lines 22*a*, 22*b* may, as illustrated, be given such shapes and proportions that the flaps do not overlap when folded towards each other on the sealed package 101, see in particular FIG. 3*b*.

Figure 4A:
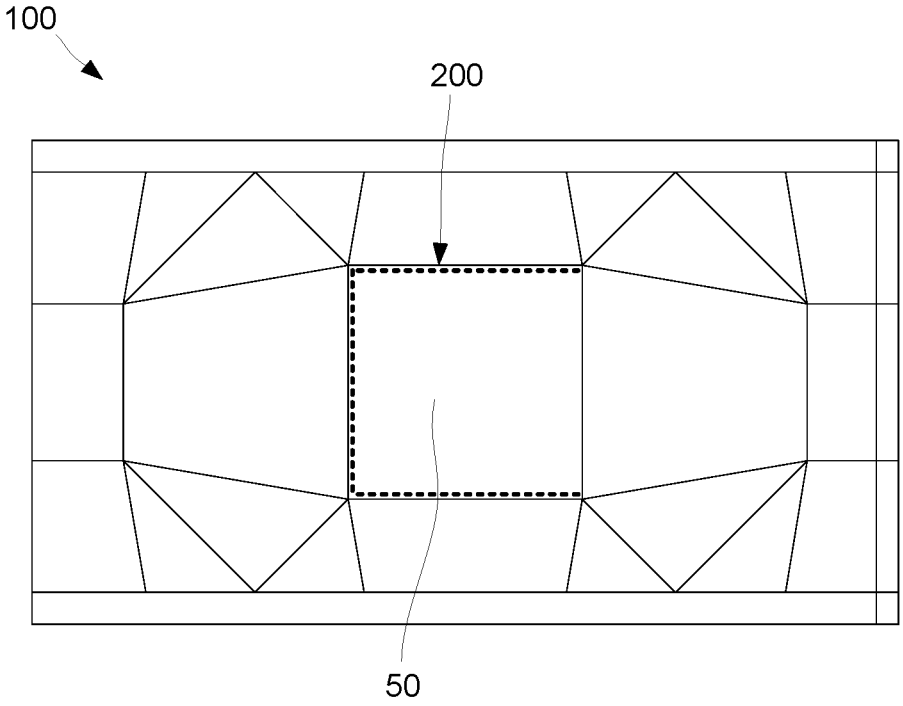
FIG. 4*a* is a top view of the sheet packaging material shown in FIG. 3*a*, now also illustrating an opening structure.
Figure 4B:
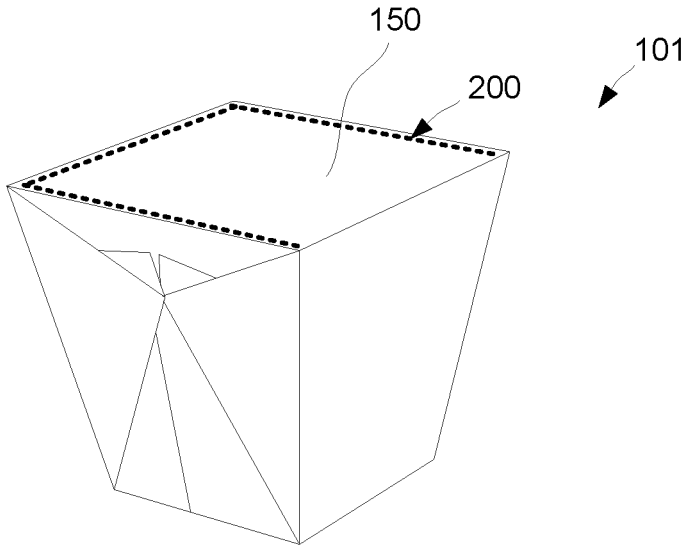
FIG. 4*b* is a perspective view of the package produced by the sheet packaging material shown in FIG. 4*a*.

With reference to FIGS. 4*a* and 4*b*, the sheet packaging material 100 may have an opening structure 200 that extends along at least three sides of the central portion 50. This allows the top panel 150 to be released such that the sealed package 101 can be opened. Examples of opening structures are conventional plastic steering ribbons that are made part of the relevant edges of the central portion 50. Pull tab system that rips the package along the edges of the central portion may also be used. Alternatively or additionally, the opening structure 200 may be a weekend portion that allows a consumer to push though the package such the it rips open along the weekend portion. In one embodiment the package has no opening structure, in which case it may be opened with e.g. a knife or a pair of pointed scissors. Other shapes of the opening structure than the illustrated one may be used. For example, it may have the form of a cross that is located on the top panel 150.

By using the described sheet packaging material 100 a sealed package 101 may be produced, which may be sealed to contain a liquid food product that is enclosed within the sealed package 101.

From the description above follows that, although various embodiments of the invention have been described and shown, the invention is not restricted thereto, but may also be embodied in other ways within the scope of the subject-matter defined in the following claims.

The invention claimed is:

1. A sheet packaging material for producing a sealed package containing a food product, said sheet packaging material comprising a first edge, a second edge parallel to the first edge, a third edge, a fourth edge parallel to third edge, the third and fourth edges joining the first and second edges such that the sheet packaging material has a rectangular shape, a first crease line and a second crease line that extend in parallel between the first and second edges, a third crease line and a fourth crease line that extend in parallel between the first and second edges and intermediate the first and second crease lines, a fifth crease line and a sixth crease line that extend between the first and second crease lines, a seventh crease line and an eight crease line that extend between the first and second crease lines and intermediate the fifth and sixth crease lines, the crease lines dividing the sheet packaging material into a rectangular, central portion configured to form a top panel of the sealed package, a first side portion and a second side portion that are adjacent the central portion and opposite each other, and configured to form a first side panel and a second side panel of the sealed package, a third side portion and a fourth side portion that are adjacent the central portion and opposite each other, and configured to form a third side panel and a fourth side panel of the sealed package, and two end portions that are adjacent two of the side portions and configured to be joined to each other to form a bottom panel of the sealed package, wherein the seventh and eight crease lines comprise a first pair of crease sections that define two opposite sides of the first side portion, wherein the first pair of crease sections are angled towards each other such that the first side portion has a trapezoidal shape, the seventh and eight crease lines comprise a second pair of crease sections that define two opposite sides of the second side portion, wherein the second pair of crease sections are angled towards each other such that the second side portion has a trapezoidal shape, and a distance between the first pair of crease sections decreases as a distance from the central portion increases, and a distance between the second pair of crease sections decreases as a distance from the central portion increases, such that the area of the top of the sealed package is larger than the area of the bottom of the sealed package.

2. A sheet packaging material according to claim 1, wherein the first pair of crease sections is, as seen relative the central portion, located opposite the second pair of crease sections.

3. A sheet packaging material according to claim 1, wherein the first pair of crease sections are slanted towards each other with same angles, such that the first side portion has the shape of an isosceles trapezoid, and the second pair of crease sections are slanted towards each other with same angles, such that the second side portion has the shape of an isosceles trapezoid.

4. A sheet packaging material according to claim 1, wherein the crease lines divide the sheet packaging material into a first flap portion and a second flap portion that are adjacent to and on opposite sides of the first side portion, and configured to form a first flap and a second flap that are folded on the first side panel of the sealed package, a third flap portion and a fourth flap portion that are adjacent to and on opposite sides of the second side portion, and configured to form a third flap and a fourth flap that are folded on the second panel of the sealed package, the fifth and sixth crease lines comprise a third pair of crease sections that together with the first pair of crease section define sides of the first flap portion and the second flap portion, wherein the third pair of crease sections are angled towards each other such that the first flap portion and the second flap portion have the shape of parallelograms, and the fifth and sixth crease lines comprise a fourth pair of crease sections that together with the second pair of crease section define sides of the third flap portion and the fourth flap portion, wherein the fourth pair of crease sections are angled towards each other such that the third flap portion and the fourth flap portion have the shape of parallelograms.

5. A sheet packaging material according to claim 4, wherein each flap portion comprises a respective pair of crease lines that divide the flap portion into three sections each having a triangular shape, wherein the first crease line of the pair of crease lines is, compared to the second crease line of the pair of crease lines longer, and located further away from a central line that extends through the centers of the first and second side portions.

6. A sheet packaging material according to claim 1, wherein the third and fourth crease lines comprise a fifth pair of crease sections that define two opposite sides of the third side portion, wherein the fifth pair of crease sections are angled towards each other such that the third side portion has a trapezoidal shape, and the third and fourth crease lines comprise a sixth pair of crease sections that define two opposite sides of the fourth side portion, wherein the sixth pair of crease sections are angled towards each other such that the fourth side portion has a trapezoidal shape.

7. A sheet packaging material according to claim 6, wherein a distance between the fifth pair of crease sections decreases as a distance from the central portion increases, and a distance between the sixth pair of crease sections decreases as a distance from the central portion increases, such that the area of the top of the sealed package is larger than the area of the bottom of the sealed package.

8. A sheet packaging material according to claim 6, wherein the fifth pair of crease sections are slanted towards each other with same angles, such that the third side portion has the shape of an isosceles trapezoid, and the sixth pair of crease sections are slanted towards each other with same angles, such that the fourth side portion has the shape of an isosceles trapezoid.

9. A sheet packaging material according to claim 1, comprising an opening structure that extends along at least three sides of the central portion, for allowing the top panel to be released such that the sealed package can be opened.

10. A sealed package made of a sheet packaging material according to claim 1, comprising a liquid food product that is contained within the sealed package.

* * * * *